US008757370B2

(12) United States Patent
Krok et al.

(10) Patent No.: US 8,757,370 B2
(45) Date of Patent: Jun. 24, 2014

(54) RETAINING DISPOSABLE SHAVER BLADE CARTRIDGES IN A SEALED CONDITION AND SIMULTANEOUSLY RETAINING THE SHAVER HANDLE IN A CONDITION FOR IMMEDIATE SHAVING USE

(75) Inventors: Paul Krok, Culver City, CA (US); Brian Steinhobel, Bryanston (ZA)

(73) Assignee: Bonfit America Inc., Culver City, CA (US)

( * ) Notice: Subject to any disclaimer, the term of this patent is extended or adjusted under 35 U.S.C. 154(b) by 117 days.

(21) Appl. No.: 13/401,361

(22) Filed: Feb. 21, 2012

(65) Prior Publication Data

US 2013/0213829 A1 Aug. 22, 2013

(51) Int. Cl.
*B65D 81/24* (2006.01)
*B65D 81/26* (2006.01)

(52) U.S. Cl.
USPC ..... 206/208; 206/204; 206/354; 206/457; 220/4.24; 220/830

(58) Field of Classification Search
USPC ..... 206/204, 205, 208, 352, 354, 355, 457; 220/4.22, 4.24, 4.25, 246, 827, 830
See application file for complete search history.

(56) References Cited

U.S. PATENT DOCUMENTS

| | | | | | |
|---|---|---|---|---|---|
| 2,531,066 | A * | 11/1950 | Lynch | 220/827 |
| 2,551,859 | A | 8/1951 | Thompson | |
| 2,788,911 | A * | 4/1957 | Mellon | 220/4.21 |
| 3,152,716 | A * | 10/1964 | Feldhahn | 220/230 |
| 3,346,952 | A | 10/1967 | Harris | |
| 3,352,630 | A * | 11/1967 | Fischer et al. | 206/208 |
| 5,209,345 | A * | 5/1993 | Haugabook | 220/832 |
| 5,615,858 | A | 4/1997 | Sferruzza, Jr. | |
| 6,145,657 | A * | 11/2000 | Cox | 206/208 |
| 8,342,322 | B2 * | 1/2013 | De'Rennaux | 206/204 |
| 2009/0056151 | A1 | 3/2009 | Kohring et al. | |
| 2009/0057170 | A1 * | 3/2009 | Kohring et al. | 206/228 |
| 2009/0172958 | A1 | 7/2009 | Prudden, Jr. et al. | |
| 2009/0183379 | A1 | 7/2009 | Johnson | |
| 2009/0188816 | A1 | 7/2009 | Purohit | |
| 2011/0204049 | A1 * | 8/2011 | Weder et al. | 220/4.24 |

* cited by examiner

*Primary Examiner* — Luan K Bui
(74) *Attorney, Agent, or Firm* — Thomas I. Rozsa

(57) ABSTRACT

A container that retains a razor blade cartridge within the container with a handle attached to the razor blade cartridge with the handle partially within the container and partially extending out of the container. The container is a spring biased container to keep it closed and it is necessary to provide a force that overcomes the spring force and open the container so that the handle and attached razor blade cartridge can be removed from the container which then snaps shut due to the closing spring force, the safety razor with razor blade cartridge and handle are ready for immediate use.

5 Claims, 8 Drawing Sheets

RETAINING DISPOSABLE SHAVER BLADE CARTRIDGES IN A SEALED CONDITION AND SIMULTANEOUSLY RETAINING THE SHAVER HANDLE IN A CONDITION FOR IMMEDIATE SHAVING USE

BACKGROUND OF THE INVENTION

1. Field of the Invention

The present invention relates to the field of retainers for retaining a safety razor and with shaving blade cartridge attached to the handler so that the safety razor is in condition for immediate shaving use when it is removed from the container.

2. Description of the Prior Art

The following ten patents and published patent applications are relevant to the present invention.

1. U.S. Pat. No. 2,551,859 issued to Marcus C. Thompson on May 8, 1951 for "Razor Supporting Means" (hereafter the "Thompson Patent");

2. U.S. Pat. No. 3,346,952 issued to Theodore J. Harris on Oct. 17, 1967 for "Safety Razor Holder and Case" (hereafter the "Harris Patent");

3. U.S. Pat. No. 3,352,630 issued to George A. Fischer et al. on Nov. 14, 1967 for "Razor Sterilizer" (hereafter the "Fischer Patent");

4. U.S. Pat. No. 5,615,858 issued to Gerald A. Sferruzza, Jr. on Apr. 1, 1997 for "Holder for Shaver" (hereafter the "Sferruzza Patent");

5. U.S. Pat. No. 6,145,657 issued to Jerry Cox on Nov. 14, 2000 for "Storage Device For A Shaving Razor" (hereafter the "Cox Patent");

6. United States Published Patent Application No. 2009/0056151 to Douglas Robert Kohring et al. published on Mar. 5, 2009 for "Razor Storage Case Having Cartridge Securing Supports" (hereafter the "'005615 Kohring Published Patent Application");

7. United States Published Patent Application No. 2009/0057170 to Douglas Robert Kohring et al. published on Mar. 5, 2009 for "Razor Storage Case Having Mating Closure Members" (hereafter the "'0057170 Kohring Published Patent Application");

8. United States Published Patent Application No. 2009/0172958 to John Prudden, Jr. et al. published on Jul. 9, 2009 for "Pivot Inhibiting Razor Storage Case" (hereafter the "Prudden Published Patent Application");

9. United States Published Patent Application No. 2009/0183379 to Ryan Lawrence Johnson published on Jul. 23, 2009 for "Self Cleaning Blade Razor Holder" (hereafter the "Lawrence Published Patent Application");

10. United States Published Patent Application No. 2009/0188816 to Ankur Purohit published on Jul. 30, 2009 for "Wet Razor Storage System and Container" (hereafter the "Purohit Published Patent Application").

The Thompson Patent discloses a container for retaining a safety razor entirely within the container. This invention discloses the concept of having a spring biased container where the entire safety razor is entirely in the container as.

The Harris Patent discloses a safety razor holder and case. The device essentially is designed to retain the razor as best shown in FIG. 1. The outer corner 7 of the cavity is rounded to correspond generally with the forward surface of the razor head; while each inner corner 18 defines a shoulder 19 for engaging the corresponding inner surface 20 of the razor head.

The Fischer Patent discloses the concept of a case which entirely contains a safety razor within the case. Specifically, the patent discloses:

"A receptacle for storing a razor head in a vertical position with the blade mounting head immersed in a sterilizing solution. The receptacle is placed in a horizontal position for removal of the razor therefrom by opening a lid. The sterilizing solution is stored within an internal pocket when the receptacle is in the horizontal position to avoid leakage."

The Sferruzza Patent discloses a wall holder for an arced and handled shaving device. The device essentially has a cup as best illustrated in FIG. 1 which can be mounted on a wall with a safety razor retained within the cup.

The Cox Patent discloses a storage device for a shaving razor. In this respect the device is a container and the safety razor is within the container with a handle extending out of the container. A handle slot 6 capable of receiving a razor handle is formed in roof 27. In the preferred embodiment, the handle slot 6 is a centered slot as shown in FIG. 1.

The '0056151 Kohring Published Patent Application discloses:

"A wet shaving razor case suitable for storage of a razor wherein the razor includes a cartridge and adjoining handle and wherein the case comprises an upper portion comprising a handle-receiving recess and a lower portion joined to the upper portion wherein the lower portion comprises a lower spacing member disposed between a forward leverage support and a rear leverage support wherein the cartridge engages with the forward leverage support upon insertion of a leading front surface of the razor into the case."

The '0057170 Kohring Published Patent Application discloses a razor storage case having mating closure members. The patent discloses:

"A wet shaving razor case suitable for storage of a razor having a cartridge and adjoining handle, the case comprises an upper portion comprising a cartridge hold down member disposed at a periphery of said upper portion and a handle-receiving recess; a lower portion joined to the upper portion wherein the lower portion comprises a engagement member positioned along a periphery of the lower portion; and wherein upon closure of the upper portion onto the lower portion the hold down member both secures the cartridge within the case and engages with the engagement member to maintain closure of the upper portion on the lower portion."

The Prudden Published Patent Application discloses:

"A wet shaving razor case suitable for storage of a razor having a cartridge and adjoining handle. The cartridge is pivotal about a pivot axis with respect to the handle. The case includes a lower portion and an upper portion. The upper portion includes a handle-receiving recess and is removably secured to the lower portion between an open position and a closed position. When in the closed position the cartridge is positioned within the case, the handle extends from the case and the case inhibits the cartridge from pivoting with respect to the handle."

The Johnson Published Patent Application discloses a self-cleaning razor blade holder. Specifically, the patent application discloses:

"The present invention includes two main types of razor holders: a self cleaning blade razor hanger, and a self cleaning blade razor stand. The self cleaning blade razor hanger has a hook adapted to hang on a horizontal object including but not limited to a rod, shelf, basket, or plumbing item; a cup shaped container for the purpose of: (a) holding a cleaning and sanitizing agent, such as but not limited to: (1) rubbing alcohol, (2) barbershop/salon disinfectant, or (3) shaving oil; and (b) holding and submersing the entire razor head, including the blade(s), in said cleaning and sanitizing agent; a hinged lid or cover on top of said cup shaped container, having a notch or slot in said lid or cover to allow the razor handle to protrude up through said lid or cover; and a cradle affixed to said hook for the purpose of supporting the handle of said razor in an upright position."

The Purohit Published Patent Application discloses a wet razor storage system and container. Specifically, the patent application discloses:

"A storage vessel for holding between shaves a wet razor with its head and cutting blade submerged in a liquid and its handle held out of the liquid and dry. The vessel liquid is comprised of a mixture of hydrophobic and hygroscopic materials and of anti-viral and anti-bacterial materials, effective to reduce cutting blade oxidation due to exposure to water and air during nonuse storage and to maintain the blade sharp and sanitary for shaving comfort. These materials specifically might be mineral oil and calcium chloride (CaCl.sub.2), and nano-gold or nano-silver."

SUMMARY OF THE INVENTION

The present invention is a container that retains a razor blade cartridge within the container with a handle attached to the razor blade cartridge with the handle partially within the container and partially extending out of the container on an arcuate handle support base.

The container is a spring biased container to keep it closed and it is necessary to provide a force that overcomes the spring force and opens the container so that the handle and attached razor blade cartridge can be removed from the container which then snaps shut due to the closing spring force, the safety razor with razor blade cartridge and handle are ready for immediate use.

It is therefore an object of the present invention to provide a spring biased closed sealed container which contains a spring biased mechanism on its rear to close the container. The container has an interior chamber in which is retained at least one razor blade cartridge attached to a handle which is partially within the container and partially extend out of the container, the safety razor retained in a manner so that the safety razor is ready for immediate use when the container is opened by a force which overcomes the closing spring force. The innovation is two-fold. First, the container is spring biased closed so that a handle for a multiplicity of safety razor blade cartridges can be retained with the pointed end of the blades facing downwardly and securely retained and remain in a sharp condition. Through overcoming the spring biasing force by pressing on the back of the container, the back of the cartridge is exposed and the a handle of a safety razor which is attached to the razor blade cartridge can then be removed so that the container can be closed after the razor blade cartridge and attached handle have been removed.

It is a further object of the present invention to provide a container which retains the razor blade cartridge and attached handle in an in use condition, so that the safety razor can be used for shaving purposes without having to hand touch the razor blades or the cartridges and accidently cut a finger.

It is a further object of the present invention to provide an antiseptic pill container within the chamber so that the razor blade is kept free of germs and in a sanitary condition.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
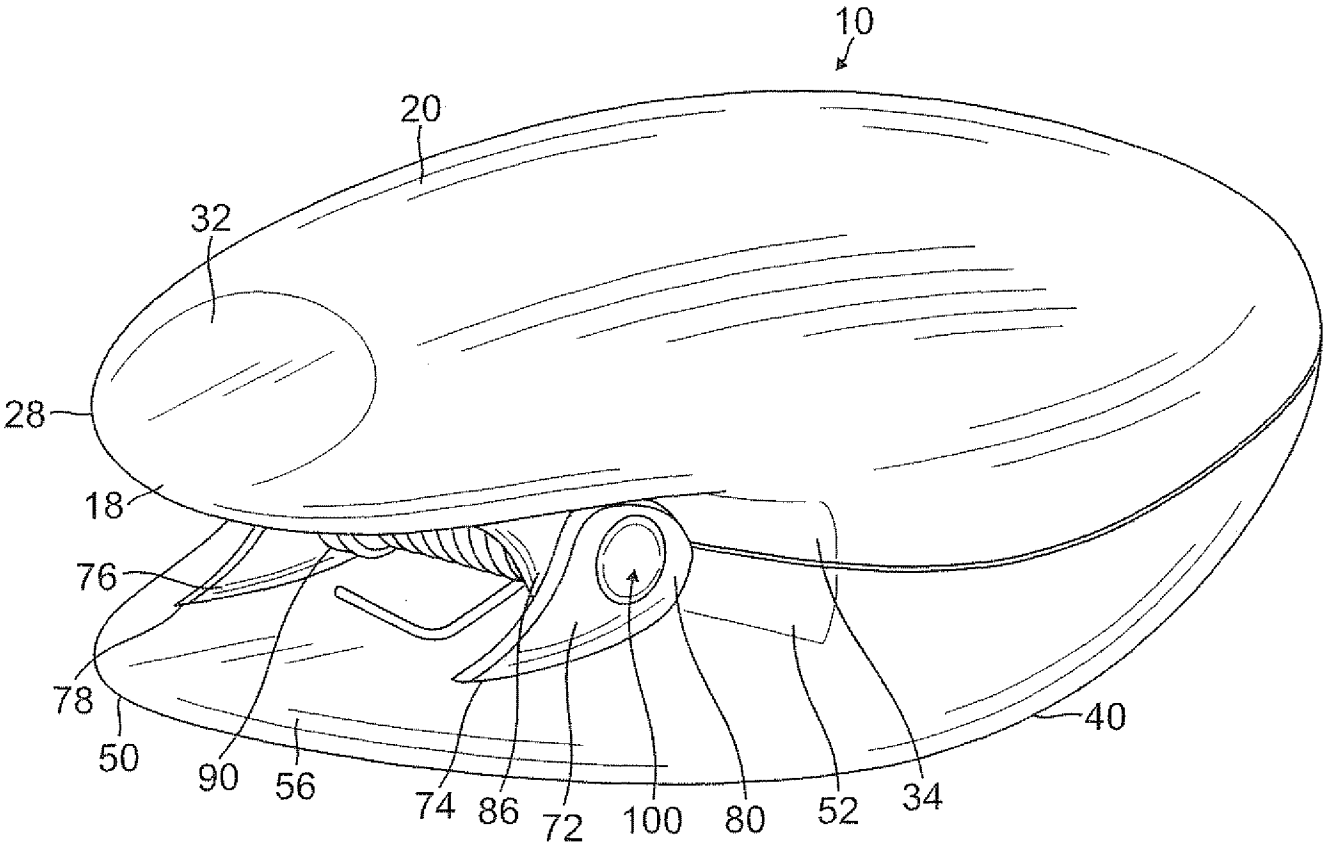
FIG. 1 is a top perspective view of the present invention safety razor container without the safety razor cartridge retained therein.
Figure 2:
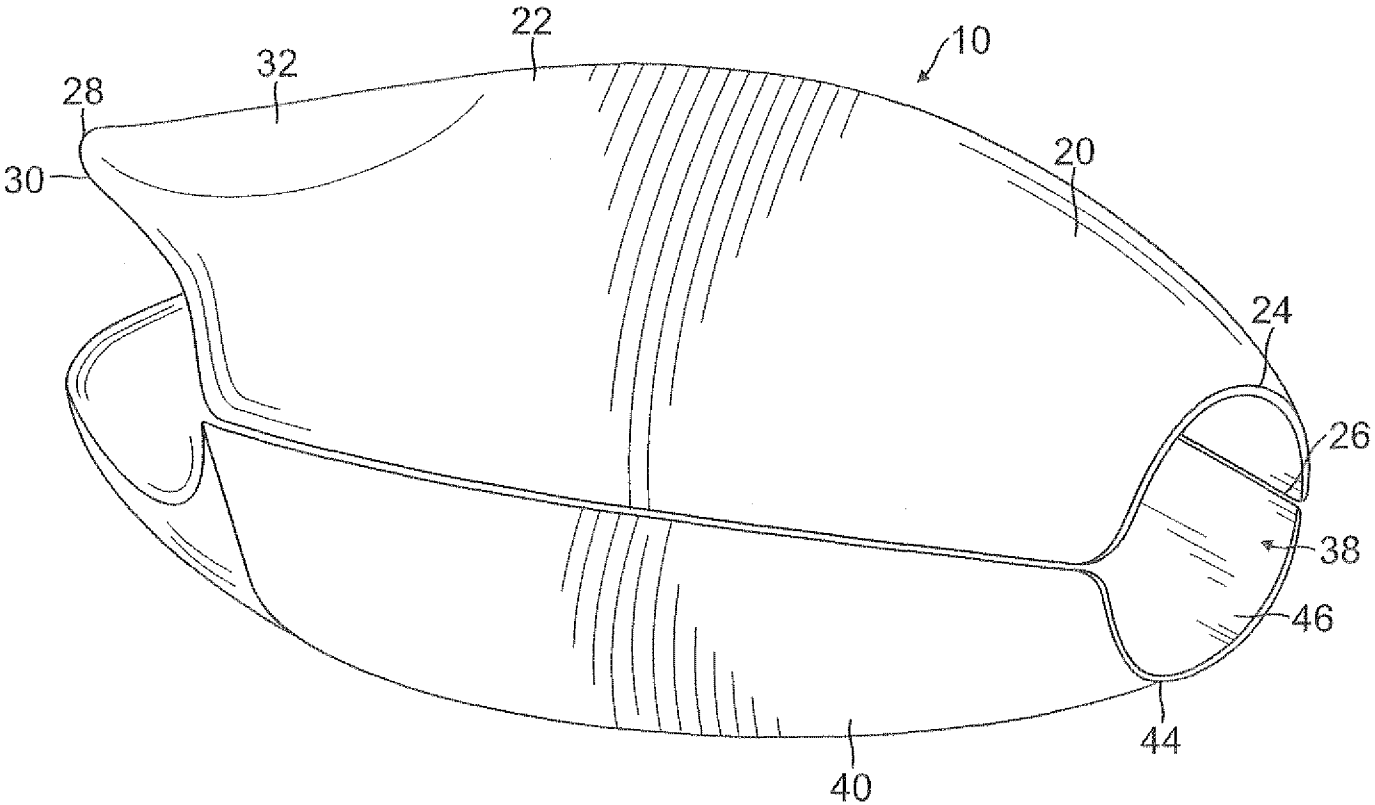
FIG. 2 is a front perspective view of the present invention safety razor container without the safety razor cartridge retained therein.
Figure 3:
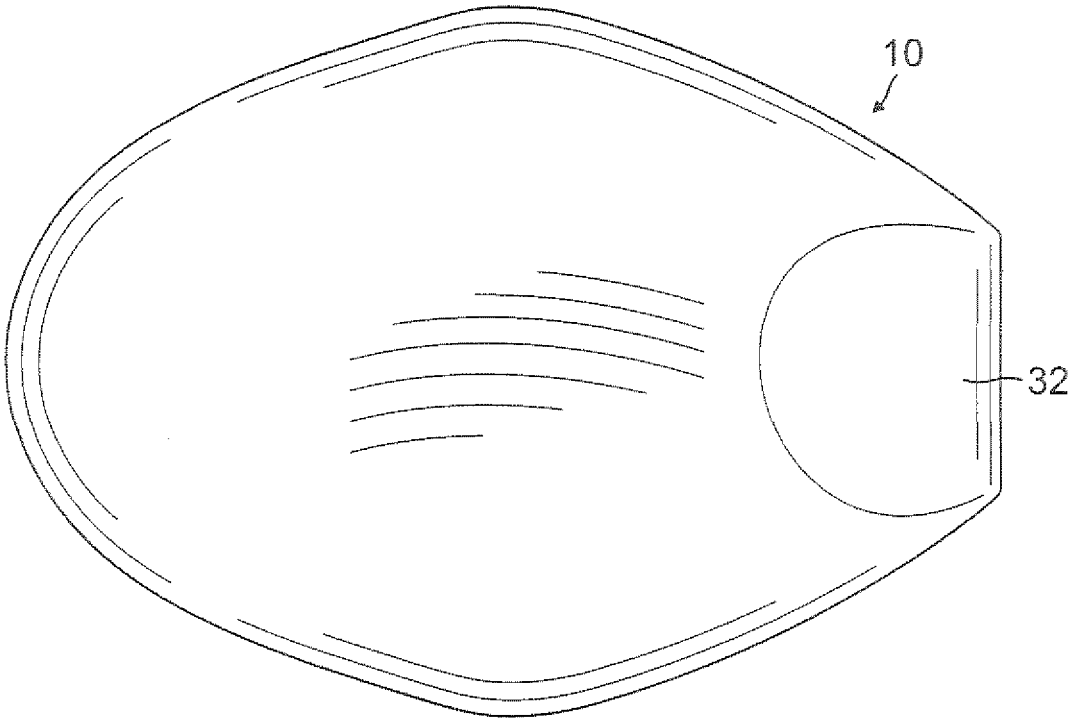
FIG. 3 is a top view of the present invention safety razor container without the safety razor cartridge retained therein.
Figure 4:
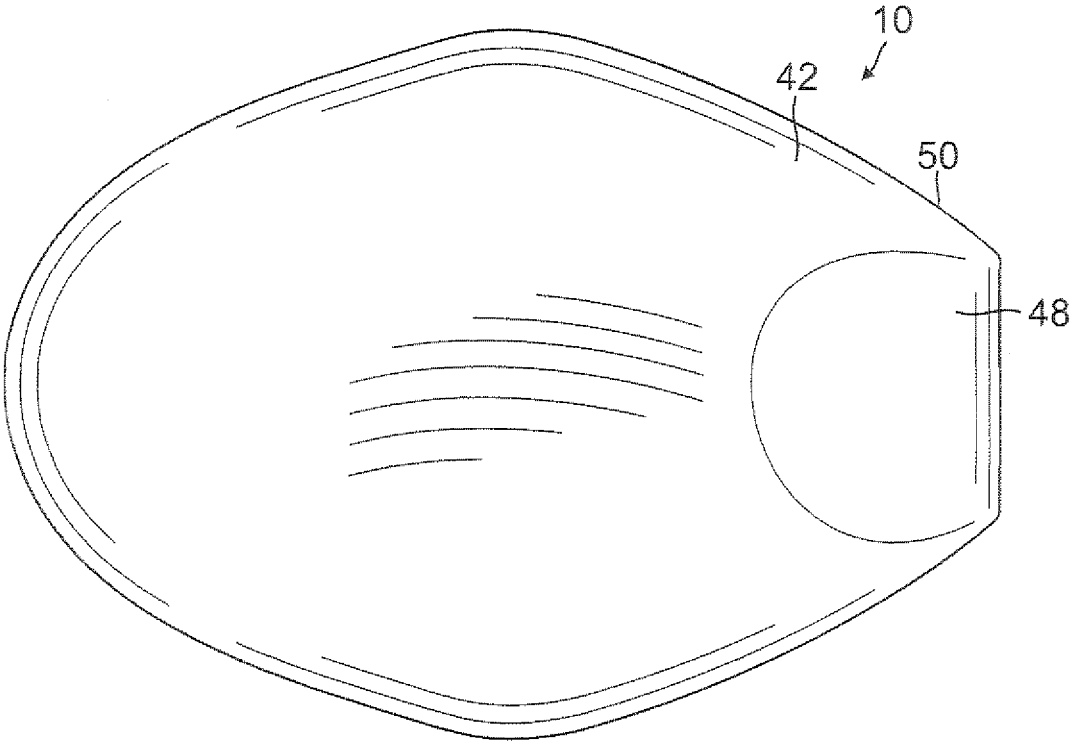
FIG. 4 is a bottom view of the present invention safety razor container without the safety razor cartridge retained therein.
Figure 5:
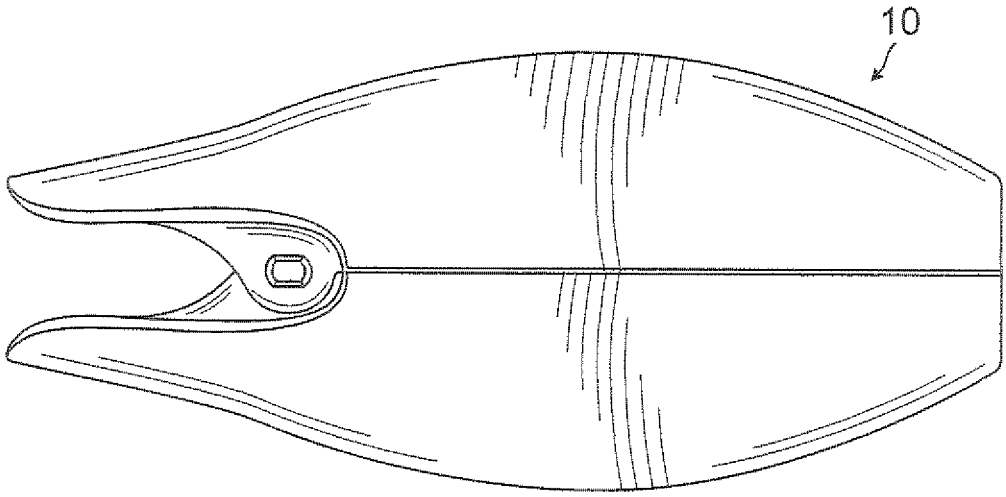
FIG. 5 is a right side view of the present invention safety razor container without the safety razor cartridge retained therein.
Figure 6:
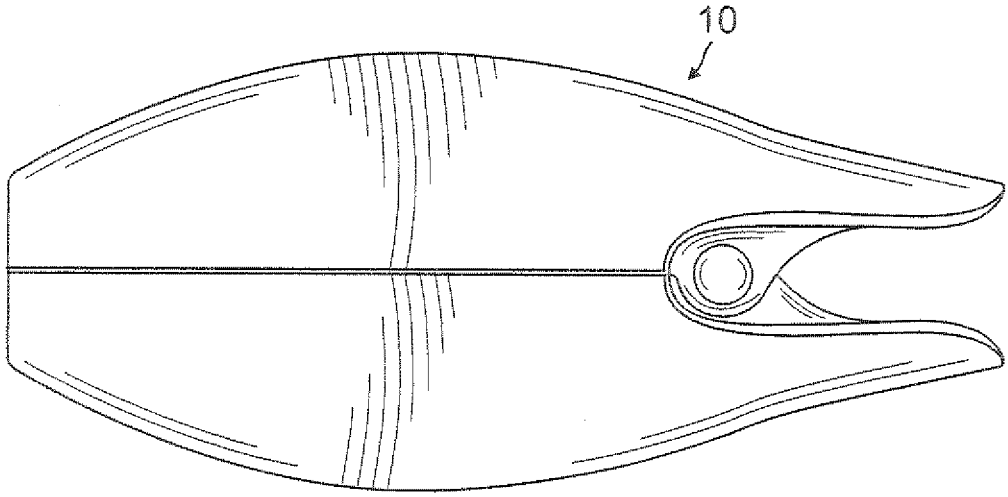
FIG. 6 is a left side view of the present invention safety razor container without the safety razor cartridge retained therein.
Figure 7:
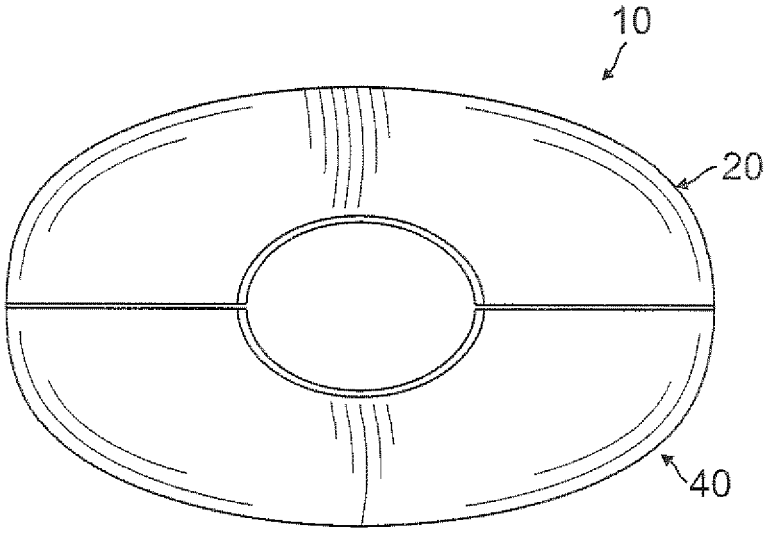
FIG. 7 is a front view of the present invention safety razor container without the safety razor cartridge retained therein.
Figure 8:
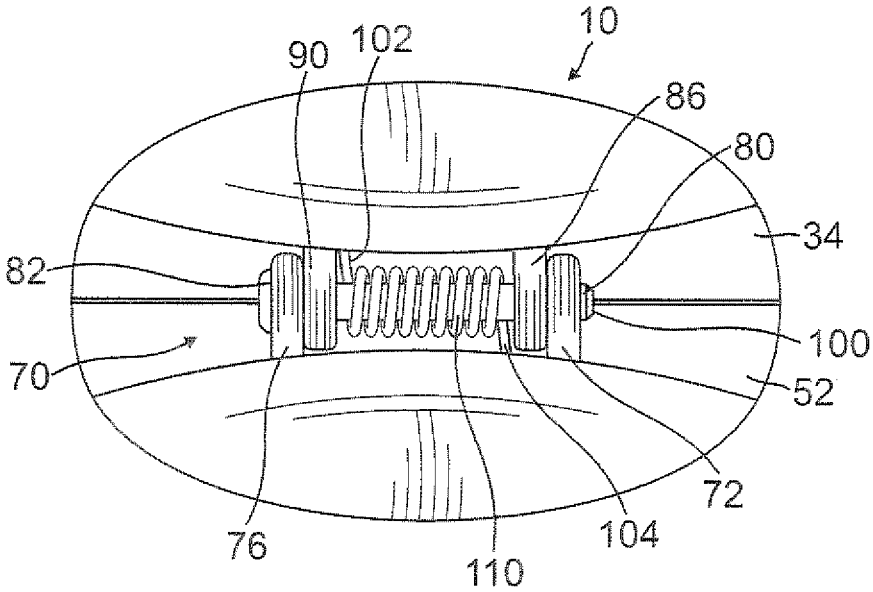
FIG. 8 is a rear view of the present invention safety razor container without the safety razor cartridge retained therein.

The first eight figures illustrate the present invention retainer 10 in the closed condition without a safety razor blade cartridge and handle. FIG. 1 is a top perspective view of the present invention safety razor container 10 without the safety razor cartridge retained therein. FIG. 2 is a front perspective view of the present invention safety razor container 10 without the safety razor cartridge retained therein. FIG. 3 is a top view of the present invention safety razor container 10 without the safety razor cartridge retained therein. FIG. 4 is a bottom view of the present invention safety razor container 10 without the safety razor cartridge retained therein. FIG. 5 is a right side view of the present invention safety razor container 10 without the safety razor cartridge retained therein. FIG. 6 is a left side view of the present invention safety razor container 10 without the safety razor cartridge retained therein. FIG. 7 is a front view of the present invention safety razor container 10 without the safety razor cartridge retained therein. FIG. 8 is a rear view of the present invention safety razor container without the safety razor cartridge retained therein.

Referring to FIGS. 1 through 8, the components of the present invention container will be described. The container 10 is generally egg-shaped, having a top section 20, an exterior top surface 22, a front end 24 with an opening 26 which constitutes a top-half of a total front opening 38, a rear end 28 with a top opening 30 and a finger depression 32 on the exterior top surface 22 adjacent the rear end 28. The top section 20 has a rear wall 34 extending downwardly from the top surface 22. The top surface also has a lower circumferential rim 36.

The container further comprises a mating bottom section 40 which is a mirror image of the top section 20, the bottom section including an exterior bottom surface 42, a front end 44 with an opening 46 which constitutes a bottom half of a total front opening 38, a finger depression 48 on the exterior bottom surface 42 adjacent a rear end 50. The bottom section 40 has a rear wall 52 which extends upwardly from the bottom surface 42. The rear walls 34 and 52 are aligned and come together. The bottom surface 42 has a top circumferential rim 54. The top section 20 and bottom section 40 are aligned and conform in shape to form a total egg-shaped body with the top circumferential rim 36 and bottom circumferential rim 54 aligned. The front openings 26 an 46 are aligned to form a complete front opening 38. Therefore, the top section 20 and bottom section 40 are aligned to surround an interior chamber 60.

A spring biased opening and closing assembly 70 is affixed adjacent to the rear walls 34 and 52 at a location between a lower surface 18 of the rear end 28 of top section 20 and an upper surface 56 of the rear end 50 of bottom section 40. The lower surface 18 and upper surface 56 are aligned and are respectively at a location rearward from the rear walls 34 and 52. While a spring is the preferred closing means, other biasing closing members are also within the spirit and scope of the present invention.

The spring biased opening and closing assembly 70 comprises a first lower arcuate post 72 having a lower arcuate section 74 which is attached to the upper surface 56 of the rear end 50 of bottom section 40. It further comprises a parallel spaced apart second lower arcuate post 76 having a lower arcuate section 78 which is attached to the upper surface 56 of the rear end 50 of bottom section 40. First arcuate post 72 has an opening 80 and second arcuate post 76 has an opening 82. A first upper arcuate post 86 is attached to and extends downwardly from lower surface 18 of the rear end 28 of top section 20 and has an opening aligned with opening 80. A second parallel upper arcuate post 90 is attached to and extends downwardly from lower surface 18 of the rear end 28 of top section 20 and has an opening which is aligned with opening 82. The two upper arcuate posts 86 and 90 respectively lie just inside of the two lower arcuate posts 72 and 76.

A dowel 100 extends through the four openings 80, two other openings not shown and 82 and is supported by the four posts 72.86, 90, and 76. A bias spring 110 is wound around dowel 100 and has spring ends, of which a first spring end 102 rests against upper surface 18 of the rear end 28 of top section 20 and the second spring end 104 rests against the upper surface 56 of the rear end 50 of bottom section 40.

The bias spring 110 forces the top section 20 and bottom section 40 of the container 10 together so that the container is in the closed position. A squeezing force on the finger depressions 32 and 48 overcomes the bias spring closing force and forces the top section 20 away from the bottom section 40 with the dowel 100 acting as the fulcrum about which the top section 20 and bottom section 40 rotate.

Figure 9:
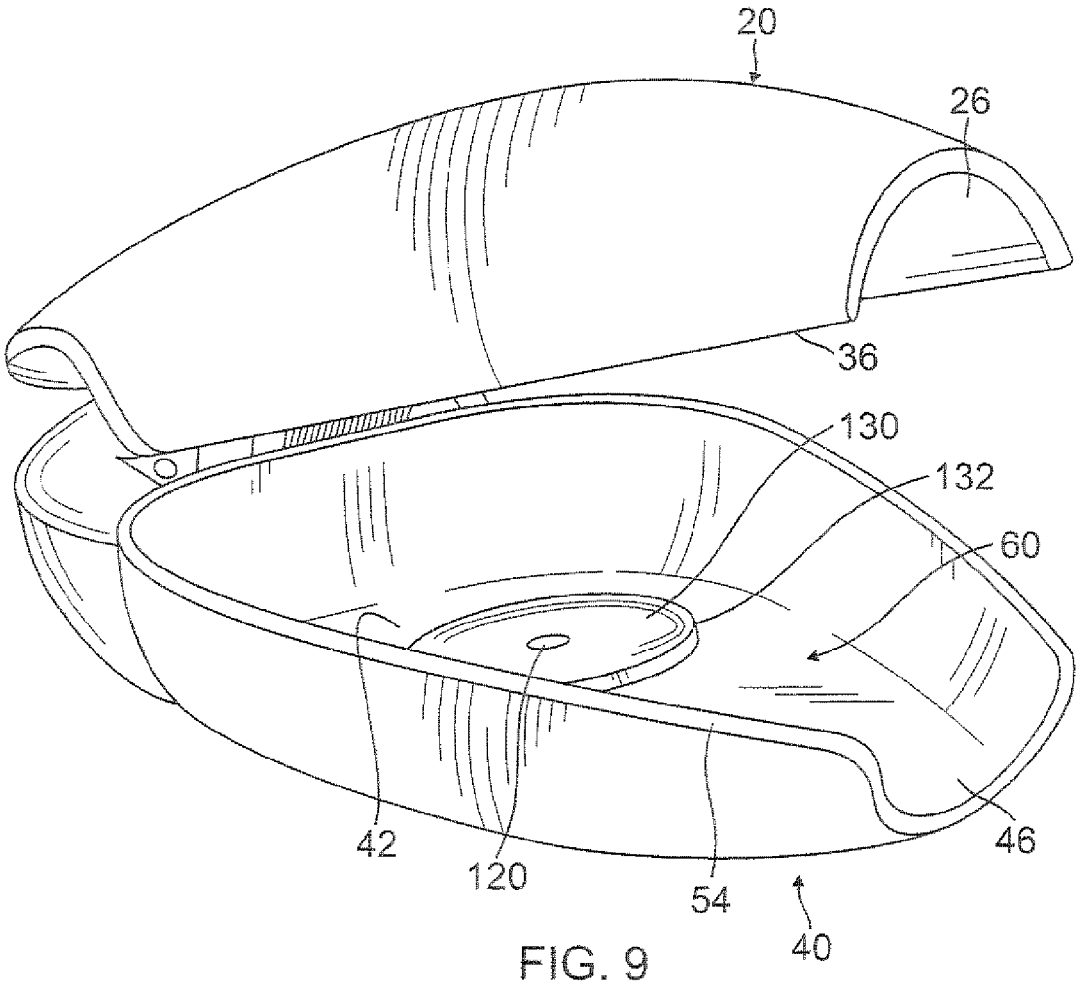
FIG. 9 is a side perspective view of the present invention safety razor container in the opened condition without the safety razor cartridge retained therein.

Referring to FIG. 9, the container 10 is shown in the opened condition with an interior chamber 60 which is surrounded by the top section 20 and bottom section 40 when closed. The interior chamber 60 further comprises a cavity 130 into which an antiseptic pill 120 can be inserted.

Figure 10:
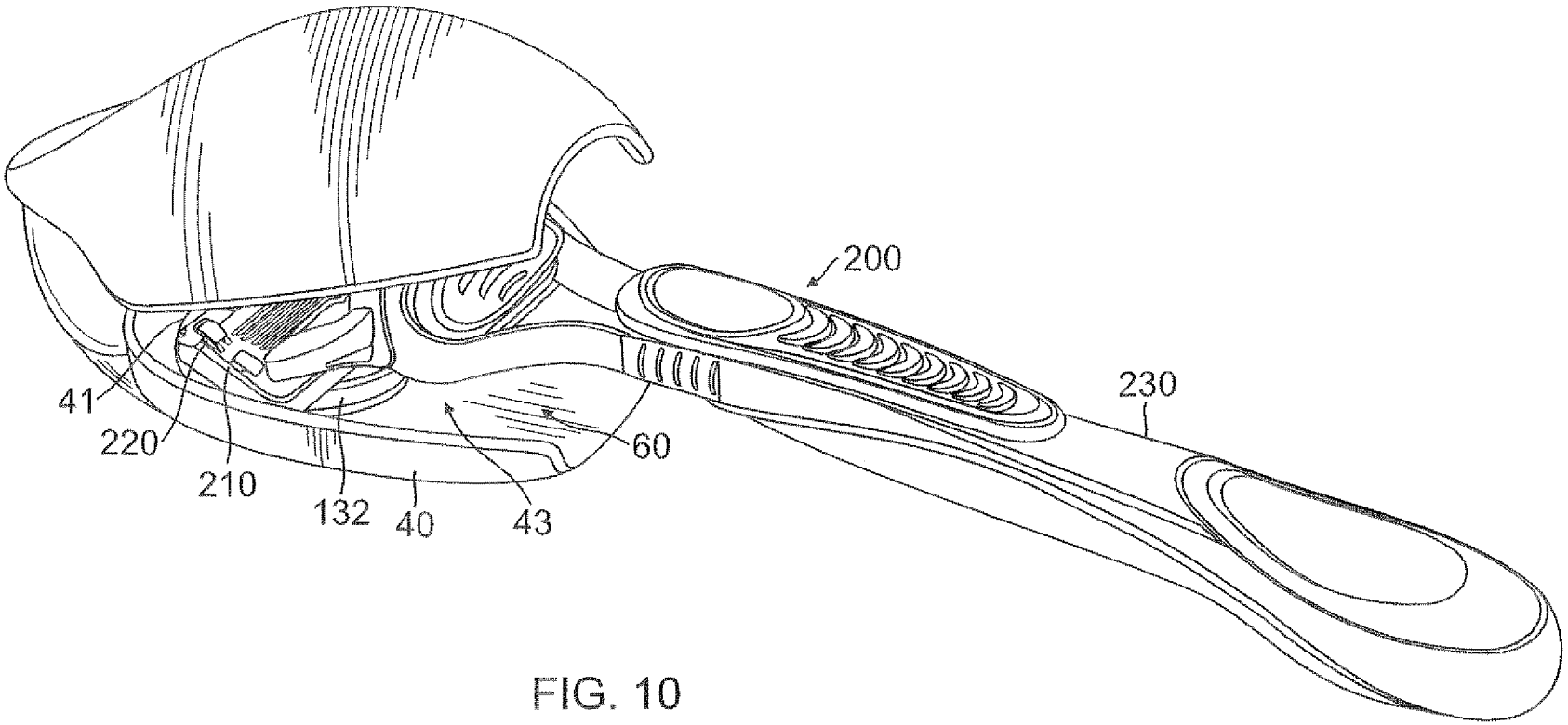
FIG. 10 is a side perspective view of the present invention safety razor container in the opened condition with the safety razor cartridge retained therein and an attached handle partially retained within the container and partially extending out of the container.

Referring to FIG. 10, a safety razor 200 is inserted into the interior chamber 60, so that a razor blade cartridge 210 rests entirely within the interior chamber 60 and is retained by a portion of the interior lower wall 41 of the bottom section 40 and the raised wall 132 of the inferior cavity 130. A razor blade 220 within the razor blade cartridge 210 faces into the interior chamber toward the interior surface 43 of bottom section 40 so that a person won't cut himself on the razor blade 220. A safety razor handle 230 is attached to the razor blade cartridge 210 and rests partially within the interior chamber 120 and extends out of the opening 38 formed by partial openings 26 and 48.

Figure 11:
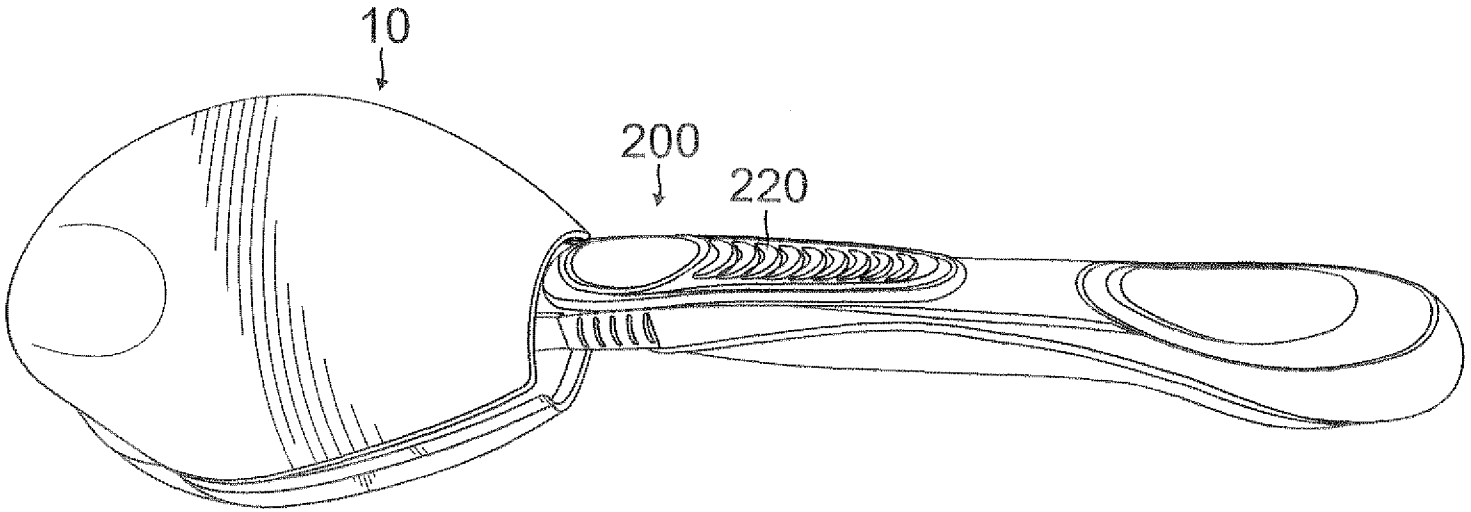
FIG. 11 is a side perspective view of the present invention safety razor container in the closed condition with the safety razor cartridge retained therein and an attached handle partially retained within the container and partially extending out of the container.

Referring to FIG. 11, the container 10 is illustrated in the closed position with a portion of the handle 230 extending out of the opening 38 formed by partial openings 26 and 46.

To use the safety razor, the container 10 is opened by a force to overcome the spring biasing closing force as previously described and when the container 10 is in the opened condition as illustrated in FIG. 10, the safety razor 200 can be quickly removed and is ready for immediate use. The antiseptic pill assures that the razor blade 230 will remain free of germs.

The container 10 can be made out of material selected from the group consisting of plastic polyethylene and metal.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A container used in conjunction with a safety razor having a razor blade cartridge and with an attached handle, comprising:

a. the container formed in a generally egg shape including a top section and a bottom section forming an enclosed container with an opening at one end and a pivoting axle adjacent an opposite end, the top section and bottom section rotatable about said pivoting axle to open and close the container, the top section and bottom section enclosing an interior chamber;

b. a biasing closing spring wound around said axle which biasing closing spring forces the top section and bottom section to come together to close the container, a downward force on a rear portion of the top section and an upward force on a rear portion of the bottom section is necessary to overcome the force of the biasing spring force to open the container;

c. the interior chamber and the opening in a front of the container are configured so the razor blade cartridge is entirely retained within the interior chamber of the container and the attached handle is partially within the interior chamber of the container and partially extends out of the front opening in the container so that upon opening the container, the safety razor is removed in one piece from the container and is ready for immediate use;

d. the razor blade cartridge includes a razor blade, the razor blade cartridge is retained within the interior chamber so that the razor blade faces toward an interior surface of the interior chamber to avoid a sharp edge of the razor blade facing out of the container when the container is opened;

e. an interior cavity with a rising wall in the interior chamber, the rising wall in combination with an interior wall of the interior chamber serving to retain the razor blade cartridge in a fixed condition within the container; and f. an antiseptic contained within said cavity.

2. The container in accordance with claim 1, further comprising:

a. the container is made of material selected from the group consisting of plastic, polyethylene and metal.

3. A container used in conjunction with a safety razor having a razor blade cartridge with an attached handle, comprising:

a. the container is generally egg-shaped, having a top section, an exterior top surface, a front end with an opening which constitutes a top half of a total front opening, a rear end having a finger depression on an exterior top surface adjacent the rear end, the top section having a rear wall extending downwardly from the top surface, the top surface also having a lower circumferential rim;

b. the container further comprising a mating bottom section which is a mirror image of the top section, the bottom section including an exterior bottom surface, a front end with an opening which constitutes a bottom-half of a total front opening, a finger depression on an exterior bottom surface adjacent a rear end, the bottom section having a rear wall which extends upwardly from the bottom surface, the top section and bottom section rear walls are aligned and come together, the bottom surface has a top circumferential rim, the top section and bottom section are aligned and conform in shape to form a total egg-shaped body with the top circumferential rim and lower circumferential rim aligned, the bottom half and top half openings respectively in the bottom section and top section are aligned to form a complete front opening, therefore, the top section and bottom section are aligned to surround an interior chamber;

c. a spring biased opening and closing assembly affixed adjacent to the rear walls at a location between a lower surface of the rear end of the top section and an upper surface of the rear end of bottom section, the lower surface and upper surface are aligned and are respectively at a location rearward from the rear walls, the spring biased opening and closing assembly comprises a first lower arcuate post having a lower arcuate section which is attached to the upper surface of the rear end of the bottom section, a parallel spaced apart second lower arcuate post having a lower arcuate section which is attached to the upper surface of the rear end of bottom section, the first lower arcuate post has an opening and the second lower arcuate post has an opening, a first upper arcuate post is attached to and extends downwardly from lower surface of the rear end of top section and has an opening aligned with the opening in the first lower arcuate post, a second parallel upper arcuate post is attached to and extends downwardly from lower surface of the rear end of top section and has an the opening which is aligned with opening in the second lower arcuate post, the two upper arcuate posts respectively lie just inside of the two lower arcuate posts, a dowel which functions as an axle extends through the two upper openings and the two lower openings in the upper and lower arcuate posts and is supported by the four posts, a bias spring is wound around the dowel and has spring ends, of which a first spring end rests against the upper surface of the rear end of the top section and the second spring end rests against the upper surface of the rear end of the bottom section;

d. the bias spring forces the top section and bottom section of the container together so that the container is in the closed position, a squeezing force on the finger depressions overcomes a closing force of the bias spring and forces the top section away from the bottom section with the dowel acting as the fulcrum about which the top section and bottom section rotate;

e. an interior chamber which is surrounded by the top section and bottom section when closed, the interior chamber further comprises a cavity having a raised wall; and f. a safety razor inserted into the interior chamber, so that a razor blade cartridge rests entirely within the interior chamber and is retained by a portion of an interior lower wall of the bottom section and the raised wall of the interior cavity, a razor blade within the razor blade cartridge faces into the interior chamber toward the interior surface of the bottom section so that a person won't cut the person by the razor blade, a safety razor handle is attached to the razor blade cartridge and rests partially within the interior chamber and extends out of the front opening formed by the top and bottom sections;

g. whereby to use the safety razor, the container is opened by a force to overcome a closing force of the bias spring and when in the container is in the opened condition, the safety razor can be quickly removed and is ready for immediate use.

4. A container used in conjunction with a safety razor having a razor blade cartridge and with an attached handle, comprising:

a. the container including a top section and a bottom section forming an enclosed container with an opening at one end and a pivoting axle adjacent an opposite end, the top section and bottom section rotatable about said pivoting axle to open and close the container, the top section and bottom section enclosing an interior chamber;

b. a biasing closing member incorporated with said axle which biasing closing member forces the top section and bottom section to come together to close the container, a force on the container is necessary to overcome the force from the biasing closing member to open the container;

c. the interior chamber and the opening in a front of the container are configured so the razor blade cartridge is entirely retained within the interior chamber of the container and the attached handle is partially within the interior chamber of the container and partially extends out of the front opening in the container so that upon opening the container, the safety razor is removed in one piece from the container and is ready for immediate use;

d. the razor blade cartridge including a razor blade, the razor blade is retained within the interior chamber so that the razor blade faces toward an interior surface of the interior chamber to avoid a sharp edge of the razor blade facing out of the container when the container is opened;

e. an interior cavity with a rising wall in the interior chamber, the rising wall in combination with an interior wall of the interior chamber serving to retain the razor blade cartridge in a fixed condition within the container; and f. an antiseptic contained within said cavity.

5. The container in accordance with claim 4, further comprising:

a. the container is made of material selected from the group consisting of plastic, polyethylene and metal.

* * * * *